US008601967B2

(12) United States Patent
Cooney

(10) Patent No.: US 8,601,967 B2
(45) Date of Patent: Dec. 10, 2013

(54) VENT FOR A PONTOON BOAT STORAGE SPACE

(75) Inventor: John R. Cooney, Midland, MI (US)

(73) Assignee: Avalon Pontoons, Alma, MI (US)

( * ) Notice: Subject to any disclaimer, the term of this patent is extended or adjusted under 35 U.S.C. 154(b) by 356 days.

(21) Appl. No.: 13/194,681

(22) Filed: Jul. 29, 2011

(65) Prior Publication Data

US 2013/0025527 A1 Jan. 31, 2013

(51) Int. Cl.

| | |
|---|---|
| ***B63J 2/08*** | (2006.01) |
| ***B63J 2/10*** | (2006.01) |
| ***B63B 1/10*** | (2006.01) |
| ***B63B 17/00*** | (2006.01) |
| ***B63B 19/04*** | (2006.01) |
| ***B63B 35/73*** | (2006.01) |

(52) U.S. Cl.

USPC ..... 114/211; 114/61.1; 114/363; 114/364; 454/79; 454/81; 454/82

(58) Field of Classification Search

USPC ..... 114/61.1, 211, 212, 292, 343, 363, 364; 454/78–82, 118, 120, 141

See application file for complete search history.

(56) References Cited

U.S. PATENT DOCUMENTS

| | | | | | |
|---|---|---|---|---|---|
| 1,439,681 | A | * | 12/1922 | Alkire et al. | 454/120 |
| 3,614,937 | A | * | 10/1971 | Schulman | 114/283 |
| 5,706,754 | A | * | 1/1998 | Menne, Jr. | 114/364 |
| 6,681,713 | B2 | * | 1/2004 | Scott et al. | 114/361 |
| D673,245 | S | * | 12/2012 | Cooney | D23/260 |

* cited by examiner

*Primary Examiner* — Ajay Vasudeva

(74) *Attorney, Agent, or Firm* — Robert L. Stearns; Dickinson Wright, PLLC

(57) ABSTRACT

A pontoon boat including a plurality of pontoons and a deck secured to the pontoons. A wall assembly is anchored to and extends upwardly from the deck to provide an interior space of the deck for accommodating passengers. The pontoon boat includes a substantially enclosed storage space defined at least in part by a portion of the deck and a portion of the wall assembly. The wall assembly has a bottom edge that is spaced off of the deck to provide a first air access opening into the storage space from beneath the wall. At least one vent is provided in the wall portion at a location spaced above the bottom edge and in open communication with the storage space. The vent enhances air flow and venting of the storage space.

14 Claims, 5 Drawing Sheets

FIG. 3
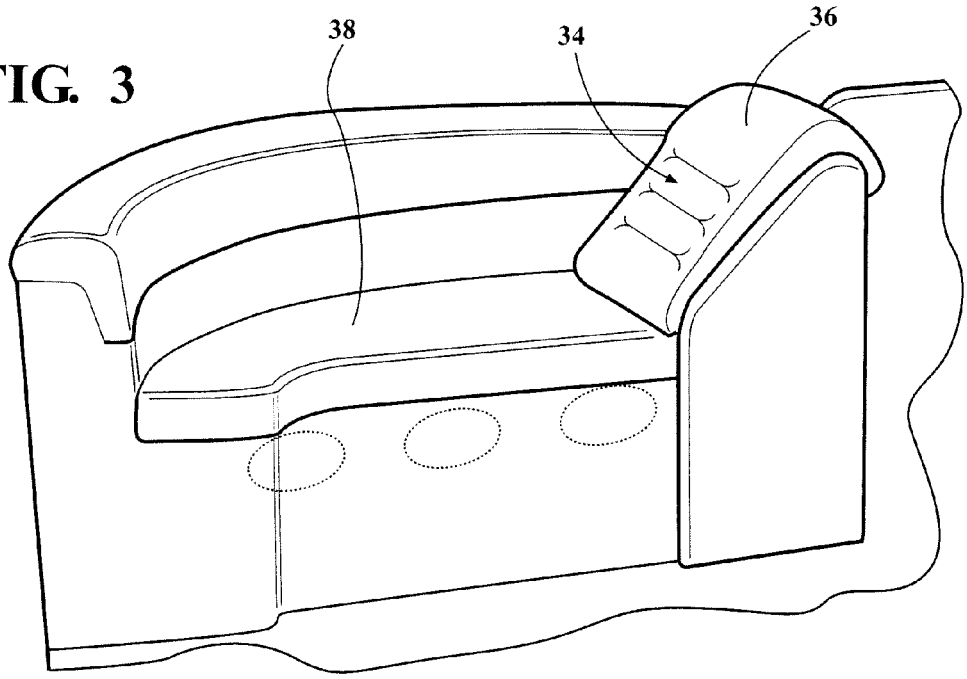
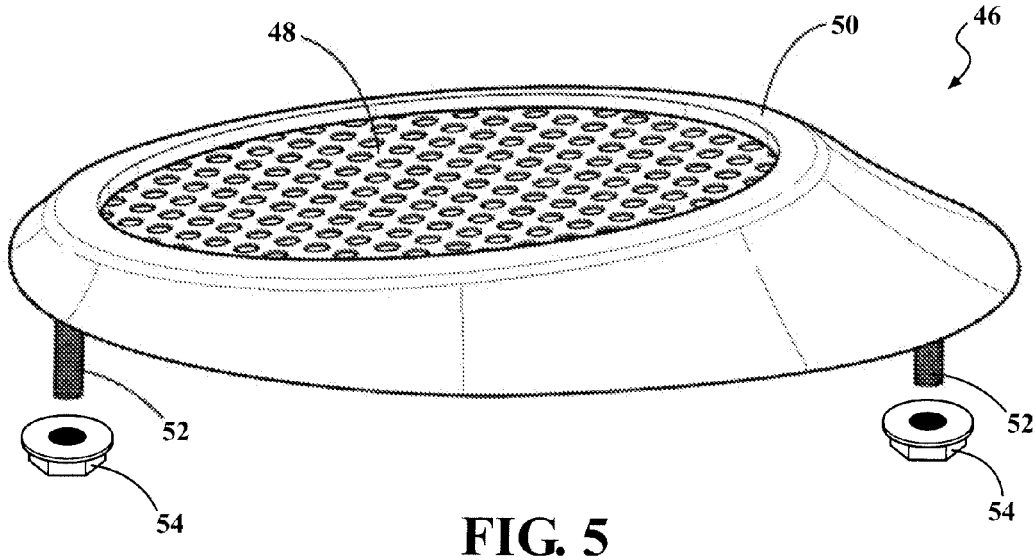
FIG. 5

VENT FOR A PONTOON BOAT STORAGE SPACE

BACKGROUND OF THE INVENTION

1. Field of the Invention

The subject invention is directed to pontoon boats, and more particularly to pontoon boats including storage spaces.

2. Description of the Related Art

Pontoon boats are becoming an increasingly popular choice among boat owners who are looking for a vessel that can accommodate a large family or group of people in a comfortable environment for leisure and/or entertainment purposes. Additional advantages of pontoon boats over other boat options include their ability to navigate shallow water with ease, their relatively low cost compared to other boat options of comparable size, the ability to configure the deck area with a variety of seating configurations and other options, and their ease of handling to name just a few.

Pontoon boats are typically constructed to include a generally flat platform or deck, which is mounted to two or more hollow, tubular floatable pontoons to support the deck off the water. The typical construction further includes some type of barrier or wall system that extends about the perimeter of the deck to define a passenger space and some type of seating arrangement within the passenger space.

Typically, pontoon boats include seats arranged throughout the interior space in a predetermined layout. To maximize the usefulness of the passenger space, these seats are often configured to include a storage space underneath a seat bottom cushion. Passengers often use these storage spaces for life jackets, towels, fenders, ropes, etc. Due to the nautical environment in which the pontoon boat operates, often these items are wet when they are put into the storage space. In order to reduce the risk of mold, fungi or bacteria growth in the storage space, some pontoon boat manufacturers have taken to raising the bottom edge of the wall system off of the deck to provide an air access opening into the storage space beneath the wall.

SUMMARY OF THE INVENTION

An aspect of the present invention is to provide a pontoon boat having at least one enclosed storage space with improved ventilation. According to this aspect, the pontoon boat includes a substantially enclosed storage space defined at least in part by a portion of the deck and a portion of the wall assembly. The portion of the wall assembly has a bottom edge which is spaced off the deck to provide a first air access opening into the storage space from beneath the wall. At least one vent is provided in the wall portion at a location spaced above the bottom edge and in open communication with the storage space to provide a supplemental air access opening into the storage space.

According to another aspect of the invention, the vent includes a non-rectangular opening and a non-rectangular vent body disposed in the opening and having a base formed with a series of perforations for allowing the passage of air through the body. This is advantageous for a number of reasons. For example, the vent body gives the pontoon boat a unique appearance which many customers find desirable. Further, the vent body can also deflect and prevent water and other objects from entering the storage space through the opening.

According to yet a further aspect of the invention, the vent body includes a peripheral rim extending about and projecting outwardly from a base. The rim extends further out from the base at the end of the vent facing the front of the pontoon than it does at the opposite end of the vent. This may be advantageous because, when the pontoon boat is travelling in a forward direction, a low pressure zone will develop at the vent opening, which will draw air out of the storage space. Fresh air then enters the storage space through the first air passage to fill the void created by the departed air. In other words, a continuous stream of air flows into and out of the storage space while the pontoon boat is in motion.

BRIEF DESCRIPTION OF THE DRAWINGS

These and other features and advantages of the present invention will be readily appreciated, as the same becomes better understood by reference to the following detailed description when considered in connection with the accompanying drawings wherein:

FIG. 3 is a perspective and elevation view of one of the seats in the exemplary pontoon boat;

FIG. 5 is a perspective and elevation view of an exemplary vent body; and

DETAILED DESCRIPTION OF THE ENABLING EMBODIMENTS

Figure 1:
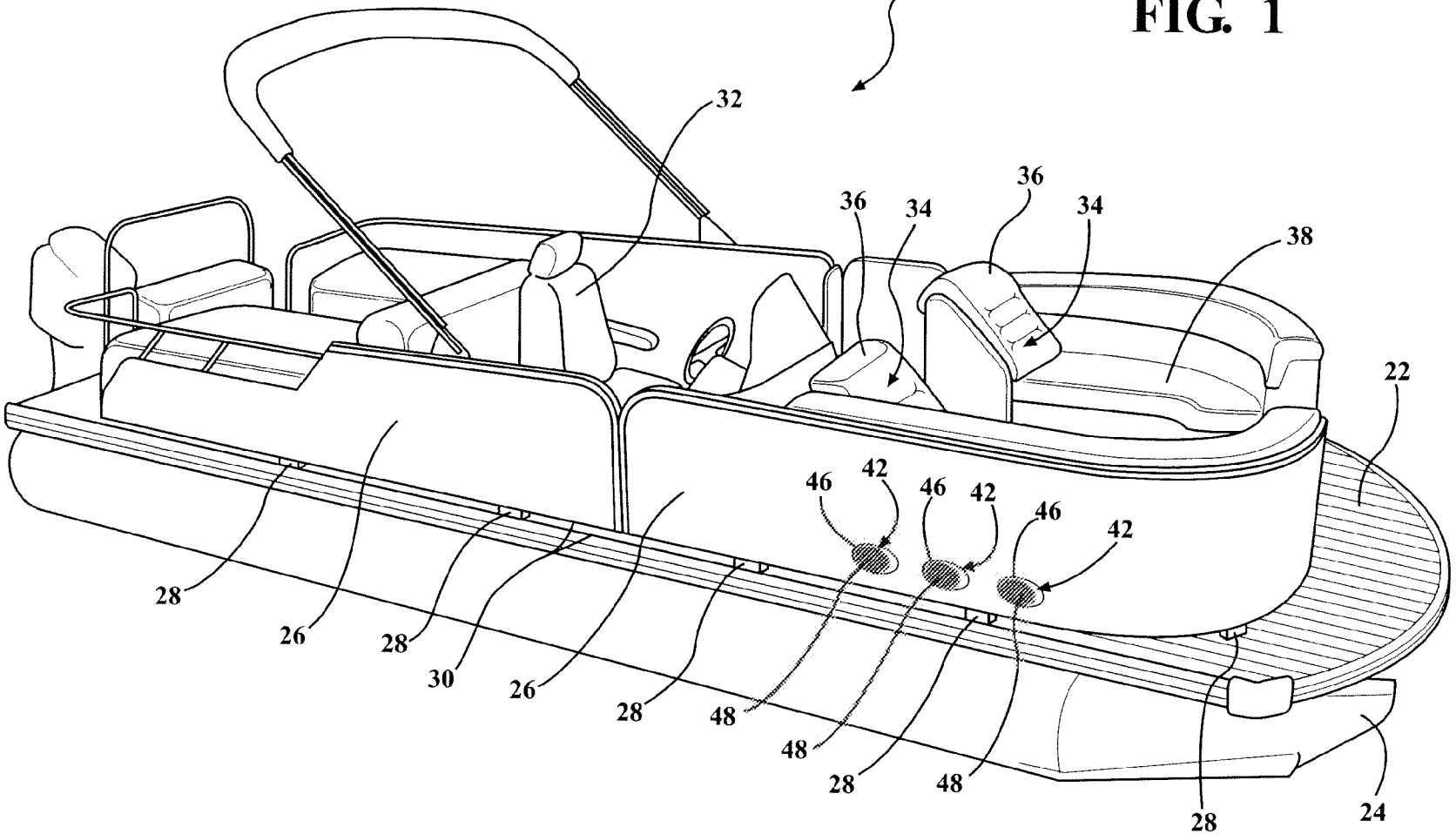
FIG. 1 is a perspective and elevation view of an exemplary pontoon boat.

Referring to the Figures, wherein like numerals indicate corresponding parts throughout the several views, an exemplary pontoon boat 20 is generally shown in FIG. 1. The pontoon boat 20 includes a deck 22 secured to a plurality of hollow, tubular floatable pontoons 24 extending in spaced and parallel relationship with one another. The exemplary pontoon boat 20 has two pontoons 24; however, it should be appreciated that it could have any desirable number of pontoons 24 (e.g. more than two).

The pontoon boat 20 includes a wall assembly which extends along the perimeter of the deck 22 to define an interior space for accommodating passengers. As shown in FIG. 1, the wall assembly includes a plurality of wall segments 26, each anchored to the deck 22 and extending generally upwardly therefrom to an open end rather than to a roof. Each wall segment 26 presents an interior surface and an exterior surface. At least the exterior surface of each of the wall segments 26 is painted; however, the interior surface of some of the wall segments 26 may also be painted, if desired.

Figure 2:
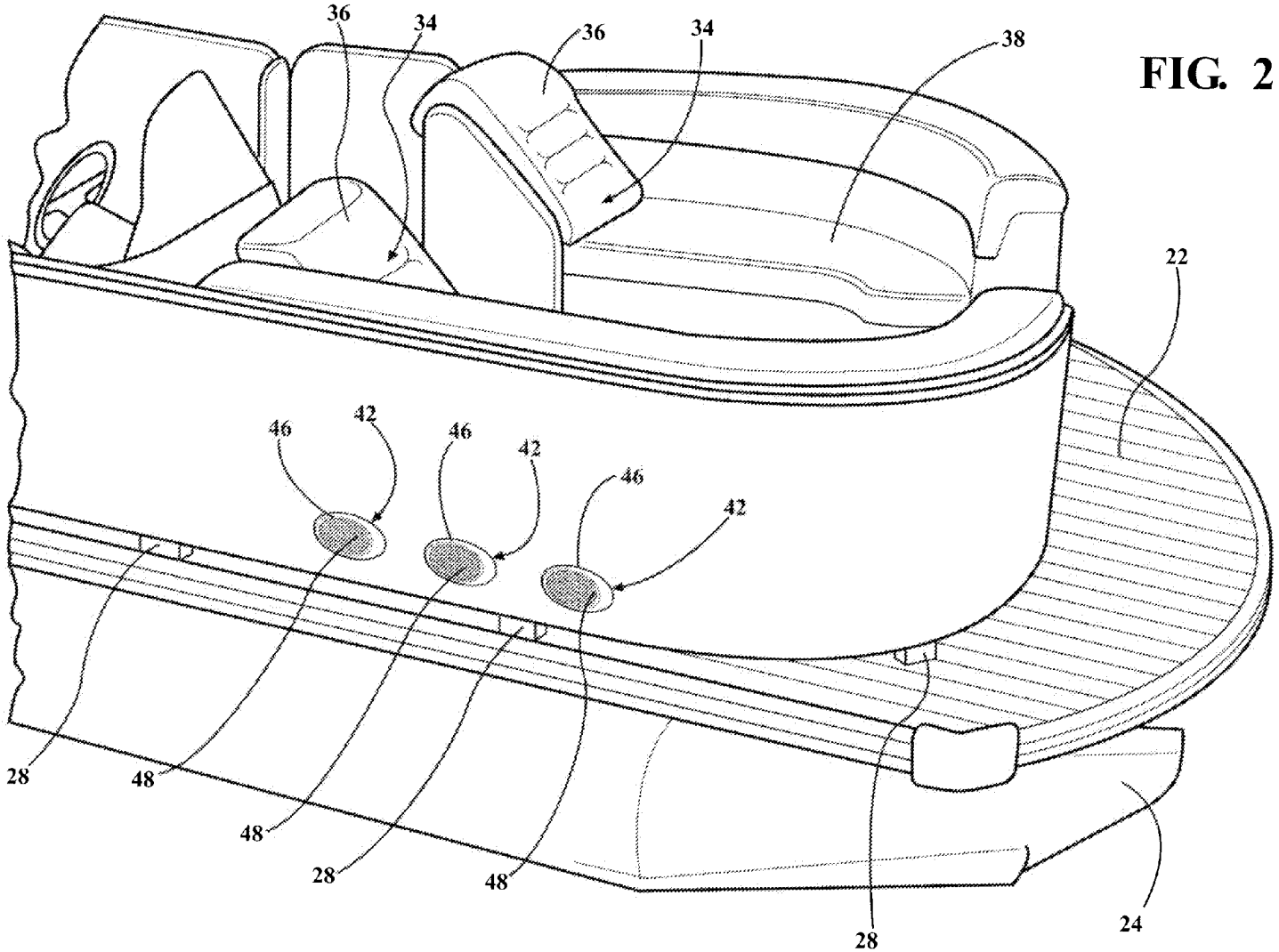
FIG. 2 is a perspective and fragmentary view of the exemplary pontoon boat and focused on one of the wall segments.

As best shown in FIG. 2, a plurality of spacers 28 are disposed between the wall segments 26 and the wall segment 26 to raise the wall segment 26 above the deck 22. In other words, there is a small gap 30 between the deck 22 of the pontoon boat 20 and the wall segments 26. This gap 30 allows water to flow out of the interior space of the pontoon boat 20, e.g. during a rainstorm. However, as will be discussed in further detail below, air can also passes through the gap 30 between the deck 22 and wall segments 26.

A plurality of seats 32, 34 are disposed in the interior space of the pontoon boat 20 for supporting passengers. For example, the exemplary pontoon boat 20 includes a captain seat 32 for a driver and a pair of corner seats 34 disposed in the front two corners of the interior space for other passengers of the pontoon boat 20. It should be appreciated that the pontoon boat 20 could take a variety of seating layouts other than the layout shown in the exemplary embodiment. Each of the corner seats 34 includes a back rest cushion 36 and a seat bottom cushion 38.

Figure 4:
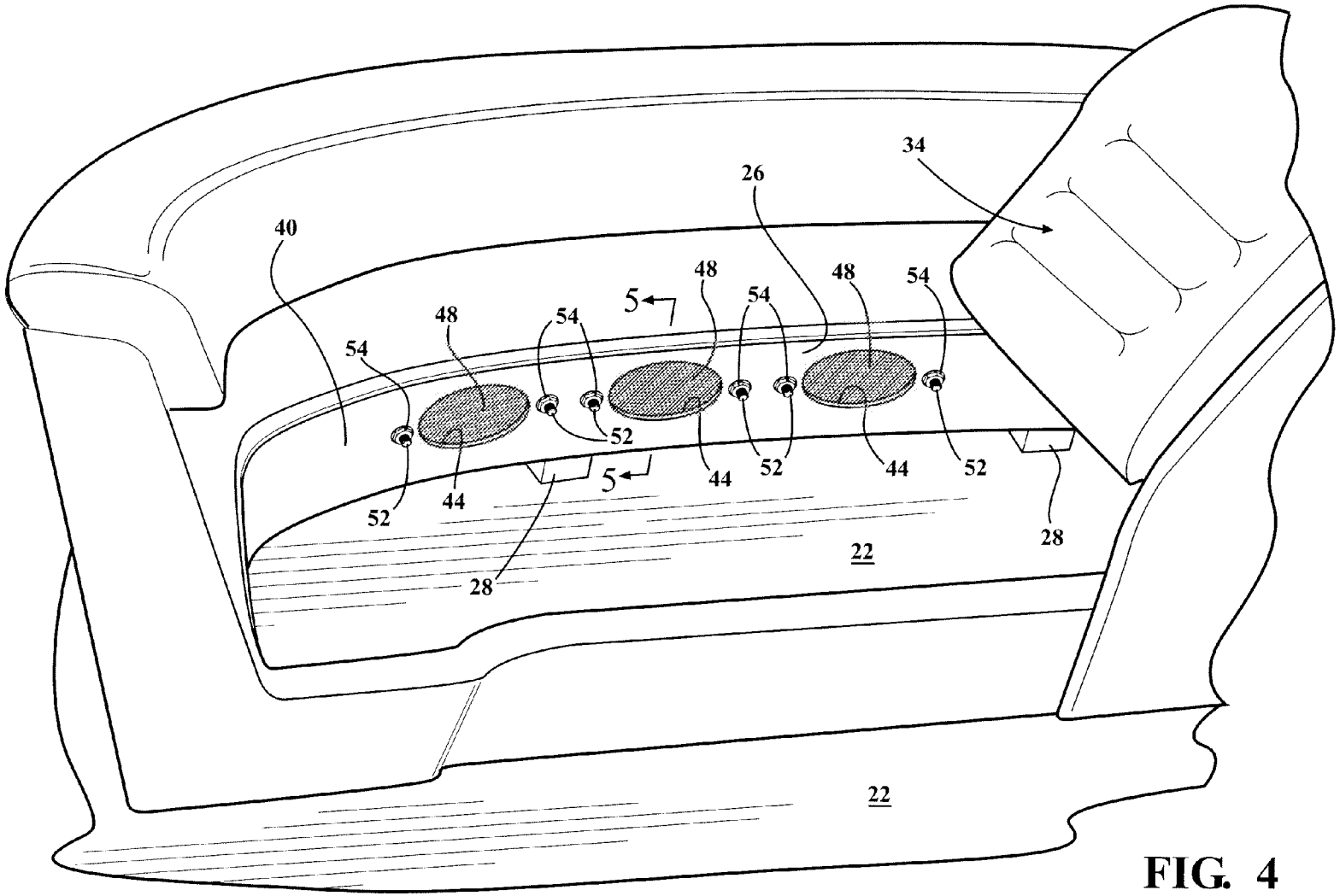
FIG. 4 is a perspective and elevation view of the seat of FIG. 3 with a seat bottom cushion removed to present a storage space.

As shown in FIG. 4, the seat bottom cushion 38 of each of the corner seats 34 can be removed to present a substantially enclosed storage space 40 within the corner seat 34. Typically, passengers store various items within these storage spaces 40, such as life jackets, towels, fenders, ski ropes, etc. Although the storage space 40 of the exemplary embodiment is within a corner seat 34, it should be appreciated that the storage space 40 could be any other type of seat or any other type of non-seat enclosure.

As shown in FIGS. 1-4, the exemplary corner seats 34 are positioned against wall segments 26, and the inner surface of the respective walls defines one of the walls of the storage space 40 below the seat bottom cushion 38. The deck 22 may also define the bottom of the storage space 40. The gap 30 between the associated wall segment 26 and the deck 22 provides a first air access opening into the storage space 40. In other words, air can flow into and out of the storage space 40 through the gap 30 beneath the associated wall segment 26.

As shown in FIGS. 1 and 2, the wall segment 26 on the side of the exemplary pontoon boat 20 adjacent the storage space 40 includes a plurality of vents 42 spaced above the bottom edge of the wall segment 26. the vents 42 are in open communication with the storage space 40 to provide a supplemental air access opening for enhancing air flow and ventilation of the storage space 40. The vents 42 are spaced vertically from the gap 30 between the deck 22 and wall segment 26, which allows air to circulate within the storage spaces 40. Specifically, air can enter the storage space 40 through either the gap 30 or the aperture and exit through the other. In the exemplary embodiment, the wall segment 26 includes three vents 42; however, it should be appreciated that the wall segment 26 could include any desirable number of vents 42.

Figure 6:
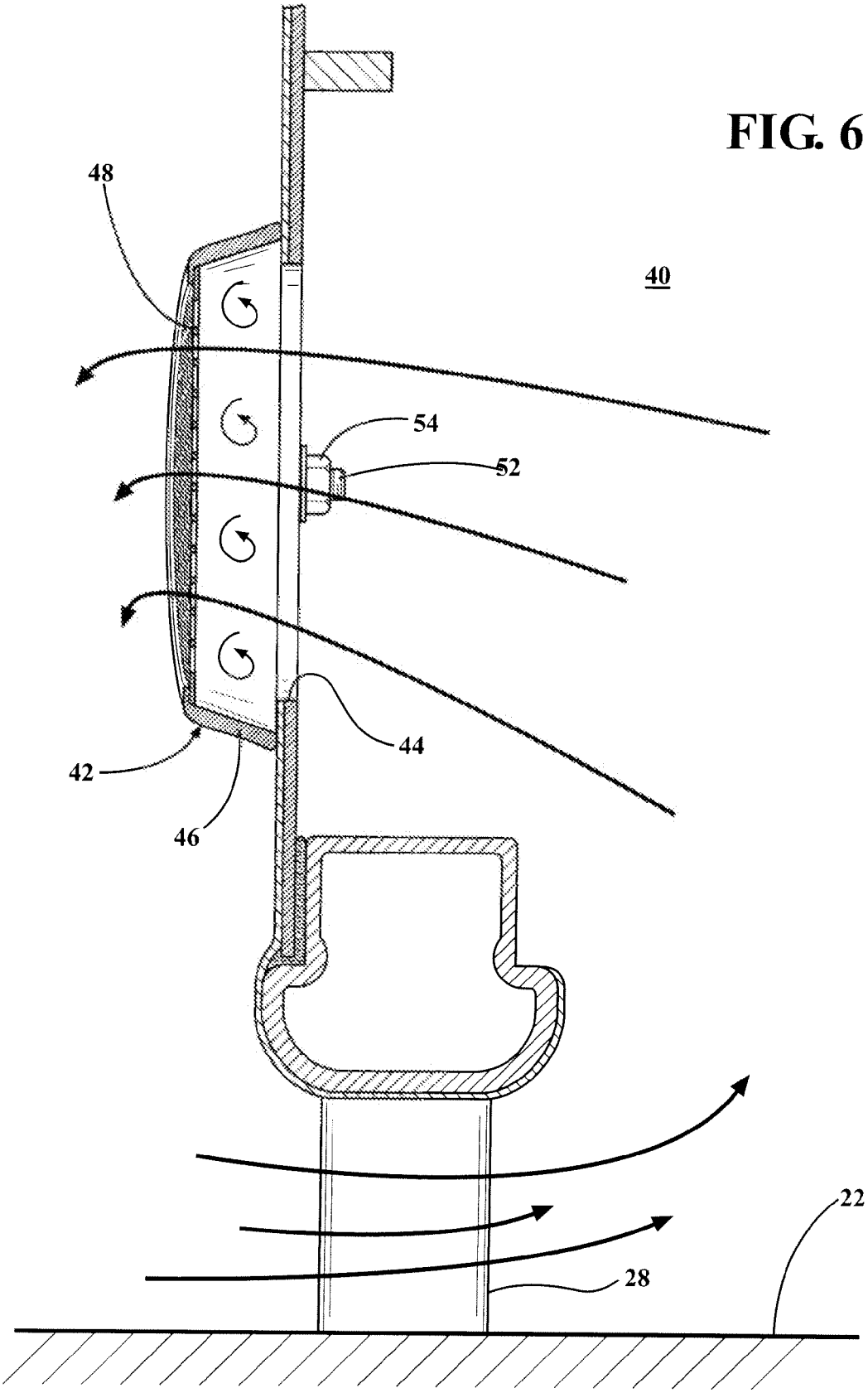
FIG. 6 is a cross-sectional view of the wall segment and the vent and showing the circulation of the air into and out of the storage space when the boat is in motion.

As shown in FIG. 4, each of the vents 42 includes a non-rectangular opening 44. Referring back to FIGS. 1 and 2, a vent body 46 is secured to the exterior surface of the wall segment 26 at each of the openings. As shown in FIG. 5, each vent body 46 is generally oval and includes a grill 48, or a base, with a plurality or perforations for allowing the passage of air through the vent body 46. The vent body 46 includes a peripheral rim 50 extending about and projecting outwardly from the grill 48. Referring back to FIG. 2, the rim 50 extends further out from the wall segment 26 at an end of the vent 42 facing the front of the pontoon boat 20 than it does at an opposite end of the vent 42 facing the rear of the pontoon boat 20. As shown in FIG. 6, when the pontoon boat 20 is travelling in a forward direction, a low pressure zone will develop at the grill 48, which will draw air out of the storage space 40. Fresh air then enters the storage space 40 through the first air passage beneath the wall segment 26 to fill the void created by the departed air. In other words, a continuous stream of air flows into and out of the storage space 40 while the pontoon boat 20 is in motion.

The grill 48 of the vent body 46 also prevents objects from entering or escaping the storage space 40 through the aperture in the wall segment 26. For example, the grill 48 could prevent a rope or any other item from accidentally falling out of the storage space 40. The grill 48 could be integrally formed with the vent body 46, or it could be secured to the vent body 46 through welding, adhesives, fasteners, etc.

As shown in FIG. 5, a pair of threaded rods 52 extend outwardly from the back of each of the vent bodies 46. As shown in FIG. 4, the threaded rods 52 extend through the wall segment 26 and receive a nut 54 in the storage space 40 to secure the vent body 46 to the respective wall segment 26. It should be appreciated that the vent body 46 could alternately be connected to the wall segment 26 through a variety of other attachment means, e.g. adhesives.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A pontoon boat comprising:

a plurality of pontoons;

a deck secured to said pontoons;

a wall assembly anchored to and extending upwardly from said deck to provide an interior space of said deck for accommodating passengers;

a substantially enclosed storage space defined at least in part by a portion of the deck and a portion of the wall assembly, said portion of said wall assembly having a bottom edge that is spaced off said deck to provide a first air access opening into said storage space from beneath said wall; and at least one vent provided in said portion of said wall assembly at a location spaced above said bottom edge and in open communication with said storage space to provide a supplemental air access opening into said storage space to enhance air flow and venting of said storage space.

2. The pontoon boat of claim 1, wherein said at least one vent comprises a plurality of vents.

3. The pontoon boat of claim 1, wherein said vent includes a non-rectangular opening and a non-rectangular vent body disposed in said non-rectangular opening and having a base formed with a series of perforations for allowing the passage of air through said vent body.

4. The pontoon boat of claim 3, wherein said vent body further includes a peripheral rim extending about and projecting outwardly of said base.

5. The pontoon boat of claim 4, wherein said rim extends further out from said base at an end of said vent facing a front of said pontoon boat than it does at an opposite end of said vent facing a rear of a pontoon boat.

6. The pontoon boat of claim 5, wherein said vent is generally oval in shape.

7. The pontoon boat of claim 6, wherein said at least one vent comprises a plurality of vents arranged in succession on said portion of said wall assembly.

8. The pontoon boat of claim 1, further including a plurality of spacers disposed between said portion of said wall assembly and said deck for raising said portion of said wall assembly off said deck.

9. The pontoon boat of claim 1, wherein said storage space is formed beneath a seat.

10. The pontoon boat of claim 9, wherein said seat includes a removable seat bottom cushion for exposing said storage space.

11. The pontoon boat of claim 1, wherein said vent includes a grill extending across said supplemental air access opening.

12. A method of ventilating a storage space in a pontoon boat comprising the steps of:

providing a pontoon boat according to claim 1;

allowing air to circulate into and out of the storage space through said first air access opening beneath the wall assembly; and allowing air to circulate into and out of said storage space through said at least one vent spaced above the bottom edge of the wall assembly to enhance air flow and venting of the storage space.

13. The method as set forth in claim 12 wherein the air is conveyed into and out of the storage space through a vent body extending outwardly from an exterior of the wall assembly.

14. The method as set forth in claim 13 wherein the vent body includes a peripheral rim angled toward a back of the pontoon boat to define a low pressure zone when the pontoon boat is moving in a forward direction.

* * * * *